US007114509B2

(12) United States Patent
Favret

(10) Patent No.: US 7,114,509 B2
(45) Date of Patent: Oct. 3, 2006

(54) DISHWASHING MACHINE WITH IMPROVED WASHING LIQUOR DISTRIBUTION VALVE

(75) Inventor: Ugo Favret, Casarsa (IT)

(73) Assignee: Electrolux Home Products Italy S.p.A., Porcia (IT)

( * ) Notice: Subject to any disclaimer, the term of this patent is extended or adjusted under 35 U.S.C. 154(b) by 539 days.

(21) Appl. No.: 10/239,539

(22) PCT Filed: Feb. 19, 2001

(86) PCT No.: PCT/EP01/01798

§ 371 (c)(1),
(2), (4) Date: Mar. 4, 2003

(87) PCT Pub. No.: WO01/82769

PCT Pub. Date: Nov. 8, 2001

(65) Prior Publication Data

US 2003/0159720 A1 Aug. 28, 2003

(30) Foreign Application Priority Data

Apr. 27, 2000 (IT) ..... PN2000A0027

(51) Int. Cl.

| | |
|---|---|
| ***B08B 3/00*** | (2006.01) |
| ***B08B 9/00*** | (2006.01) |
| ***B08B 3/12*** | (2006.01) |
| ***B08B 6/00*** | (2006.01) |

(52) U.S. Cl. ..... 134/169 R; 134/58 D; 134/168 R; 134/175; 134/176; 134/184; 134/195

(58) Field of Classification Search ..... 134/56 D, 134/58 D, 168 R, 169 F, 171, 173, 175, 176, 134/184, 190, 191, 195, 169 R
See application file for complete search history.

(56) References Cited

FOREIGN PATENT DOCUMENTS

| | | | |
|---|---|---|---|
| DE | 4310403 | A1 * | 10/1994 |
| DE | 197 50 266 | A | 5/1999 |
| EP | 569 733 | A | 11/1993 |
| EP | 569733 | A1 * | 11/1993 |
| EP | 943 281 | A | 9/1999 |
| EP | 943281 | A2 * | 9/1999 |
| WO | WO 01 03568 | A | 1/2001 |

* cited by examiner

*Primary Examiner*—Michael Barr
*Assistant Examiner*—Rita Ramesh Patel
(74) *Attorney, Agent, or Firm*—Pearne & Gordon LLP

(57) ABSTRACT

Dishwashing machine comprising a programme sequence control unit, at least two rotating spray arms, a circulation pump (3) capable of operating even intermittently, a distribution valve (10) arranged directly on the delivery-side section (6) of the pump (3) and having at least a first and a second outlet (11, 13) which communicate with a respective rotating spray arm. The shutter member (20) of the valve, in accordance with the flow direction of the liquor at the delivery side (6) of the pump, is adapted to selectively displace both between said first and second outlets (11, 13) and into an intermediate seat (15) situated between the same outlets. The duration of the pauses in the intermittent operation of the pump (3), as controlled by the programme sequence control unit, is correlated to the actual pressure at the inlet of the valve (10) by the action of means (21) provided to monitor the localized pressure of the liquor.

2 Claims, 1 Drawing Sheet

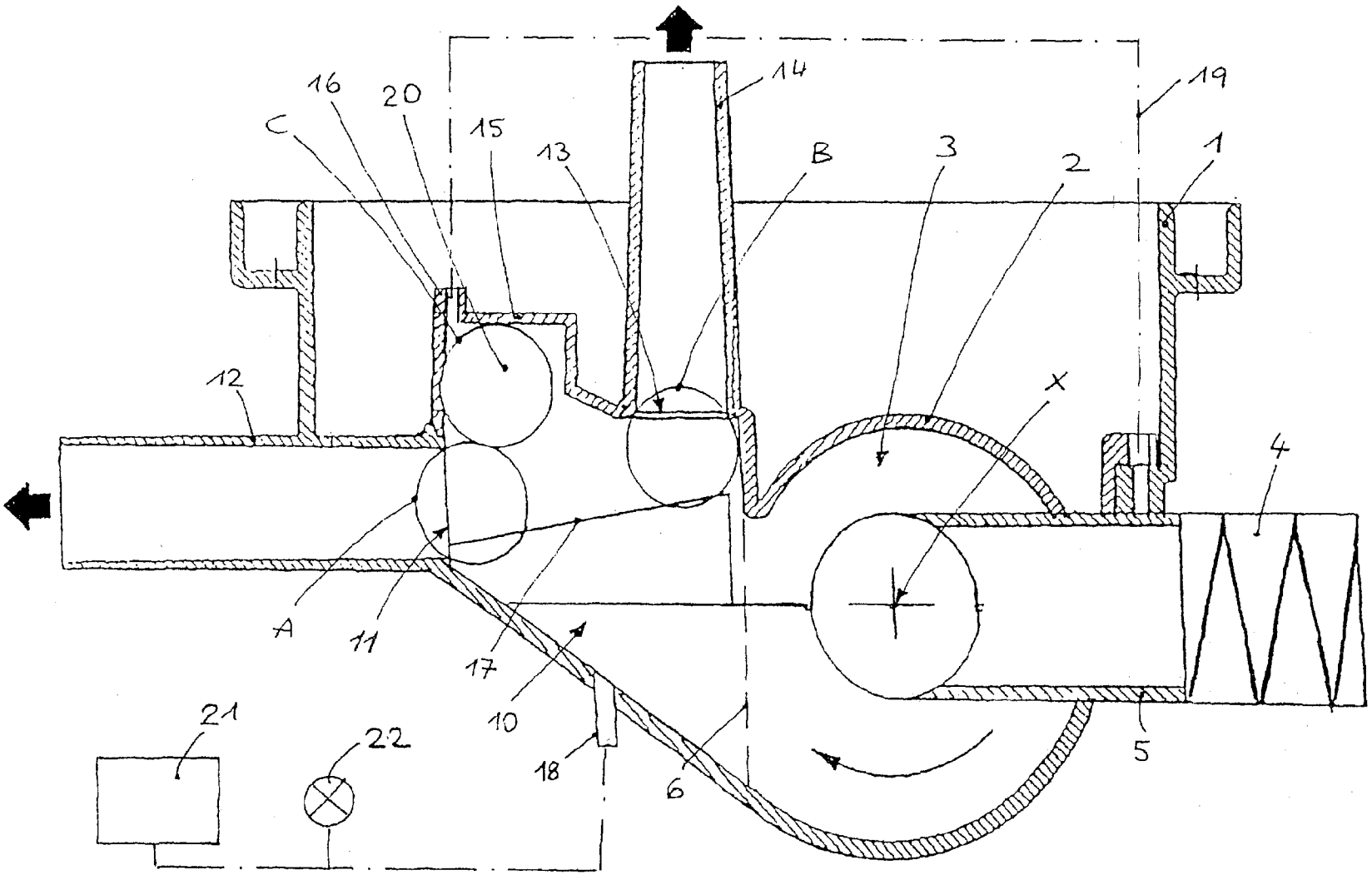
19
1
4
2
3
X
5
B
14
6
13
18
15
17
10
20
16
C
11
A
22
12
21

DISHWASHING MACHINE WITH IMPROVED WASHING LIQUOR DISTRIBUTION VALVE

This application claims the benefit of International Application Number PCT/EP01/01798, which was published in English on Nov. 8, 2001.

The present invention relates to an automatic dishwashing machine that comprises a liquor-carrying circuit including a distribution valve, which is adapted to selectively direct the liquor towards the various devices provided to spray the liquor itself on to the washload items arranged in the washing vessel of the machine, wherein it should first of all be noticed that, in the context of this patent, the term washing liquor, or simply liquor, is used to indicate both the detergent-containing water solution, which is used to carry out the actual washing, ie. soil removal phases, and the sole water medium used in rinsing phases.

The Italian patent application no. PN99A000058, filed by this same Applicant on Jul. 13, 1999, discloses a dishwashing machine comprising, on the delivery side of a circulation pump capable of operating even intermittently, a liquor distribution valve having a shutter member and at least a pair of outlets connected to rotating spray arms. A seat in the form of a sealed-bottom recess is provided on the body of the distribution valve and/or the circulation pump.

During intermittent operation of the pump, the shutter member enables in a first phase the sole lower rotating spray arm and, in a subsequent phase, the sole upper rotating spray arm to be supplied with liquor. During the pauses in the intermittent operation of the pump (depending on the duration thereof), the shutter member enables either the liquor to flow backwards or the two rotating spray arms to be supplied at the same time, when it, remains unstably accommodated in said sealed-bottom recess. The advantage of such a solution lies in the fact that, by appropriately programming the duration of the pauses, the energy usage is optimized in the first case, whereas the washing and/or rinsing effectiveness of the washing machine are optimized in the second case.

It will be obviously appreciated that the duration of the pauses in the intermittent operation of the circulation pump is rigidly pre-set by the manufacturer of the dishwashing machine for the various programmes that can be selected by the user, and is verified experimentally by the same manufacturer under and with reference to standard conditions only.

Unfortunately, the actual working or operating conditions may sometimes deviate from the standard ones. In particular, the liquor may be more or less foamy in accordance with the actual amount and quality of the detergent used, and this creates a condition of unforeseeability of the pressure of the liquor at the inlet of the distribution valve. The operation of such a valve and, as a result, the actual performance of the dishwashing machine may therefore prove unsatisfactory for the end user of the machine.

From DE-A-197 50 266 a dishwasher is also known in which the number of revolutions in a circulating pump are reduced irregularly for short periods during the rinsing program cycle. Changes in revolutions are controlled by a program in the appliance through a pressure sensor fitted in the rinsing water circuit. During the pump's cycle the pump's pressure is affected by how much foam there is or how dirty the rinsing liquid is made by the dishes. The outlet of the pump by no means is connected with a controlled valve capable of selectively distributing the rinsing liquid.

It therefore is a purpose of the present invention to provide a dishwashing machine that, while maintaining the advantageous features and capabilities of the previous above described solution, is further capable of assuring that the end user will be able to obtain the kind of performance levels as provided for and specified by the manufacturer, whichever the actual operating conditions may also be.

This and further aims of the present invention are reached in a dishwashing machine having the characteristics defined and recited in the appended claims.

In view of better illustrating the features and the advantages of the present invention, a household-type dishwashing machine of the kind with two washload carrying racks and two rotating spray arms arranged above each other is described below by mere way of non-limiting example with reference to the accompanying drawing which, for reasons of greater simplicity, solely illustrates those parts which are in a direct connection with the present invention.

The FIGURE can be seen to show, according to a vertical cross-section plane, the sump 1 on the bottom of the washing vessel of a dishwashing machine, said sump being made of injection-moulded plastic material and joined to the body 2 of the liquor circulating pump 3. Such a union of the sump 1 with the bottom of the washing vessel and said pump body 2, which is formed by two half-shells, is carried out in any of a number of manners that are well-known to those skilled in the art, so that they do not require any further explanation or description here.

The pump 3, of which the sole horizontal axis of rotation X is shown for reasons of greater simplicity, is also adapted to operate intermittently in accordance with the commands that its electric driving motor (not shown), preferably of the variable-speed type, receives from the programme sequence control unit (not shown, either) of the machine. In this particular embodiment, the heating element 4 provided to heat up the liquor is of a coiled type arranged inside the intake pipe 5 of the pump 3, which communicates with the bottom of the washing vessel.

As it is known from the afore cited patent application filed by this same Applicant, a liquor distribution valve. 10 is arranged directly on the delivery side 6 of the pump 3 and comprises a first outlet 11 communicating with the upper rotating spray arm (not shown) via a first conduit 12, and a second outlet 13 communicating with the lower rotating spray arm (not shown, either) via a second conduit 14.

On the body of the valve 10, in an intermediate position between and spaced from said first outlet 11 and said second outlet 13, there is further provided a recess 15, which has a vent 16 into a line 19 that is preferably in communication with either the intake pipe 5 of the pump 3 (see FIGURE) or the bottom of the washing vessel.

The shutter member of the valve 10 is constituted by a ball 20 that is made of a material heavier than the liquor. As described in the afore mentioned Italian patent application no. PN99A000058 of this same Applicant, to which reference should therefore be made for a more detailed description, during the intermittent operation of the pump 3, depending on the flow direction of the liquor the ball 20 is capable of selectively displacing both between said outlets 11 and 13 on a surface 17 that is inclined downwards in the direction from the impeller of the pump 3 to said first outlet 11, and towards the recess 15, out of the contact with said inclined surface 17. For a better insight, all possible positions of the ball 20 are shown in the FIGURE and indicated at A, B and C, respectively.

According to a main feature of the invention, in the lower portion of the inlet of the valve 10, ie. immediately after the delivery side 6 of the pump 3 there is provided a connection 18 for a device 21 adapted to monitor the delivery pressure of the pump 3. Such a monitoring device 21, which may be either of the electronic or the electromechanical type, is electrically connected to the already mentioned programme sequence control unit of the machine. In a preferred embodiment of the present invention, the monitoring device 21 is also connected to an indicator device 22 (eg. of the type emitting either light or sound signals) to indicate an irregular operation of the rotating spray arms of the dishwashing machine, such as their being prevented from rotating owing to a wrong or inappropriate arrangement of the washload items on the associated rack, or the liquor being sprayed irregularly.

In this way, during the intermittent operation of the pump 3, the duration of the pauses in the intermittent operation of the pump 3 is not always the same as rigidly pre-set by the machine manufacturer, but is correlated to the actual pressure sensed at the inlet of the valve 10. It therefore ensues that the kind of performance being assured to the end user (the advantages of which are duly stressed in the repeatedly mentioned patent application of this same Applicant) is exactly the one expected from the particular washing programme selected, eg. a minimization of energy usage or a maximization of the washing effectiveness.

The invention claimed is:

1. Dishwashing machine which comprises a programme sequence control unit, a circulation pump (3) adapted to also operate in an intermittent mode on command of said programme sequence control unit, at least two rotating spray arms, a liquor distribution valve (10) arranged directly on the delivery-side section (6) of said pump (3) and provided with at least a first and a second outlet (11, 13) communicating with the liquor-supply conduits (12, 14) of said rotating spray arms, respectively, and further provided with a shutter member (20) that, depending on the flow direction of the liquor on the delivery side (6) of the pump, is adapted to selectively displace both between said first and said second outlet (11, 13) and into an intermediate accommodation (15) provided between said same outlets, characterized in that it further comprises means (21) for monitoring the pressure of the liquor immediately after the delivery side (6) of the pump, so as to make it possible for the duration of the pauses in the intermittent operation of the pump (3) controlled by the programme sequence control unit to be correlated to the actual pressure of the liquor at the inlet of the valve (10), the connection (18) for said monitoring means (21) of the liquor pressure being arranged in the lower portion of the valve (10), in which the shutter member (20) of the valve (10) consists of a spherical body made of a non-oxidizing material and having a heavier specific gravity than the washing liquor itself, characterized in that said intermediate accommodation (15) between said first and said second outlet (11, 13) of the valve (10) consists of a recess provided with a vent (16) having a connecting line (19) with the intake side (5) of the pump (3).

2. Dishwashing machine according to claim 1, characterized in that said means (21) for monitoring the pressure of the liquor are also connected to indicator means (22) to indicate a possible irregular operation of the rotating spray arms.

* * * * *